US005216857A

United States Patent [19]

Harke

[11] Patent Number: 5,216,857

[45] Date of Patent: Jun. 8, 1993

[54] APPARATUS AND METHOD FOR ENABLING A SUBSEQUENT STABILIZATION OF BUILDINGS

[75] Inventor: Alfons Harke, Affligem Hekelgam, Belgium

[73] Assignee: International Intec Patent Holding Establishment, Liechtenstein, Liechtenstein

[21] Appl. No.: 742,424

[22] Filed: Aug. 8, 1991

[30] Foreign Application Priority Data

Aug. 8, 1990 [DE] Fed. Rep. of Germany ..... 4025070

[51] Int. Cl.[5] ..... E04C 3/00

[52] U.S. Cl. ..... 52/223.6; 52/744; 52/745.21

[58] Field of Search ..... 52/223 R, 227, 229, 52/220, 600, 744, 745.21, 228

[56] References Cited

U.S. PATENT DOCUMENTS

| | | | |
|---|---|---|---|
| 2,184,137 | 12/1939 | Brewer | 52/229 |
| 3,173,226 | 3/1965 | Solnick | 52/228 |
| 4,024,687 | 5/1977 | Kozak | 52/228 |
| 4,045,929 | 9/1977 | Velo Dalbrenta | 52/228 |
| 4,080,765 | 3/1978 | Fasano | 52/228 |
| 4,366,655 | 1/1983 | Mayer et al. | 52/227 |
| 4,509,305 | 4/1985 | Guinard | 52/227 |
| 4,633,700 | 1/1987 | Zandel | 52/227 |
| 4,799,307 | 1/1989 | Reigstad et al. | 52/223 R |
| 4,809,474 | 3/1989 | Ekberg, Jr. | 52/223 R |

*Primary Examiner*—Carl D. Friedman
*Assistant Examiner*—Wynn E. Wood
*Attorney, Agent, or Firm*—Antonelli, Terry, Stout & Kraus

[57] ABSTRACT

A method and apparatus for enabling a subsequent stabilization of buildings with precast floors including several longitudinally extending girders resting with respective ends thereof on opposite building walls. The ends of the longitudinally extending girders are clamped to each other and to the building end walls carrying the girders. Two outermost longitudinally extending girders of the floor zone to be stabilized are clamped together with respectively adjoining parallel building side walls by grouting anchors in such a manner that the floor zone to be stabilized is encompassed by a rugged ring anchor. The floor zone may also be reinforced by the provision of longitudinally extending and transversely extending anchors incorporated into the floor in a lattice-shaped fashion.

10 Claims, 5 Drawing Sheets

APPARATUS AND METHOD FOR ENABLING A SUBSEQUENT STABILIZATION OF BUILDINGS

FIELD OF THE INVENTION

The present invention relates to an apparatus and method for enabling a subsequent stabilization of buildings, especially, residential complexes with precast floors including a plurality. of longitudinal extending girders having respective ends thereof resting on building walls and intermediate floor slabs which, in each case, surround continuously extending cavities located between the longitudinal girders.

BACKGROUND OF THE INVENTION

Buildings with precast floors are in extreme danger of collapse during, for example, gas explosions, earthquakes, and damage due to normal subsidence or settling. This danger exists because precast floor consist, in principle, of longitudinal girders arranged loosely with respect to each other, with the longitudinal girders being placed mutually in parallel at a specific spacing and resting on building end walls which define the rooms of the buildings. The interspaces between the longitudinal girders are filled in, in most cases, by hollow floor blocks inserted in the interspaces so that non-interrupted floor surface is provided. By pouring motar or cement it is then possible to level any uneveness resulting from the construction. During this process, a frictional connection due merely to the contact forces is established between the individual mounting elements such as the longitudinal girders, the floor blocks, the compensating motar or cement, and the supporting building walls and, in some constructions, there is also provided a mechanical clamping action between specific mounting elements and the motar additionally providing a certain adhesive bond.

A disadvantage of constructions of the aformentioned type resides in the fact that such constructions merely satisfy the normally occurring applied loads and forces, that is, purely static forces and very minor vibrations as they result from traffic loads for which the floor has been designed. However, such constructions cannot withstand suddendly occurring forces such as, for example forces which occur during a gas explosion or an earthquake because the forces arising during the special occurrences are considerably larger than the originally estimated working loads. Moreover, in utilizing individual mounting elements, the individual elements exhibit a highly unstable behavior resulting in a shifting with respect to one another so that they tend to slide off building walls whereby the floors and, under certain circumstances, also the building walls will collapse.

SUMMARY OF THE INVENTION

The aim underlying the present invention essentially resides in providing an economical apparatus and method for enabling a subsequent stabilization of buildings against the risk of damages due to sudden occurrences of forces from, for example, earthquakes or gas explosions which minimizes any impairment or damage to interior rooms of the building and/or interior furnishings.

In accordance with the present invention, for stabilizing buildings having precast floors including several longitudinal girders, the respective ends of the longitudinal girders are clamped together with one another and with building end walls carrying the girders, and with two outer longitudinal girders of the floor zone to be stabilized being clamped together with respective adjoining parallel building side walls.

For this purpose, in accordance with the present invention, grounding anchors are employed as transversely extending and longitudinally extending anchors in a region of the floor near to the wall and filler plugs are subsequently formed for embedding the anchors in contact with the longitudinal girders in such a manner that the floor zone to be stabilized is encompassed by a rugged ring anchor.

By virtue of the utilization of a ring anchor, an entire building cell which, for example, may comprise even several rooms, depending upon the size of the floor zone to be stabilized, is combined into an inherently stable cell wherein the individual mounting elements such as, for example, the longitudinal girders and the room walls manufactured in one piece, for example, as prefabricated parts, are clamped together and anchored in a similarly stable fashion in a region of their supporting surfaces as in the case of a structural component produced initially as a closed reinforced concrete cell.

By stabilizing a building complex in accordance with the present invention, the building complex is capable of withstanding to a high degree any earthquakes or gas explosions since the stabilized building cells realized by the present invention can no longer entirely cave in and collapse. Consequently, occupants of a room or building are extensively protected against injuries and from being buried in building rubble, and, furthermore, any possessions contained in the building are extensively protected from damage.

Alternatively or in addition to the formation of a ring anchor, it is also possible in accordance with the present invention to proceed in such a manner that a floor zone to be stabilized is upgraded in its reinforcement over an entire surface area thereof by transversely and longitudinally extending anchors incorporated subsequently in a lattice shape and by embedding the longitudinally and transversely extending anchors by plugs of filling compound in addition to clamping the girders to the building walls.

By virtue of the last mentioned feature of the present invention, the load-bearing capacity of the floor area is increased in addition to the stabilization which is obtained by a ring anchor.

Preferably, in accordance with the present invention, a stabilizing ring anchor can be realized by providing all longitudinal girders, in a proximity of their respective longitudinal ends, and the walls extending in parallel thereto, with at least, respectively, one row of aligned transverse bores, with the building end walls carrying the ends of the longitudinal girders being provided with wall bores having an axial extension intersecting with the rows of transverse bores within the cavities. Longitudinal anchors are inserted in the wall bores and transverse anchors that can be coupled with the longitudinal anchors at the points of intersection are inserted in the rows of transverse bores. Filler plugs are formed along the transverse anchors with the cavities, with the plugs being in contact with the longitudinal girders and the longitudial anchors and fixing these in their position in the transverse direction. Filler plugs are formed along the longitudinal anchors within the cavities in such a manner that they form with the filler plugs of the transverse anchors and interlock in a shape-mating fashion in a region of the points of intersection and immovably clamp the transverse anchors and the longitudinal girders connected thereto in place with respect to the building end walls.

In order to obtain a structure of the ring anchor which is stable also along the two exteriorly located longitudinal girders, in accordance with further features of the present invention, the building walls in parallel to the longitudinal girders and the respective proximate longitudinal girder are provided with a aligned transverse bores, with the transverse anchors being inserted in the aligned transverse bores, and with the filler plugs being formed in a cavity respectively disposed in the floor inwardly of the outer longitudinal girders. The filler plugs embed the anchor end and extend in each case behind the longitudinal girders in a region of the transverse bores.

When the precast floor to be stabilized rests on intermediate walls or partitions, it is also possible in accordance with the present invention to orient the wall bores in a zone of the intermediate walls in an oblique fashion so that the outermost end lies above or below the building floor.

In a similar manner, if the building floor is continued or extends past an exterior wall to form, for example, a balcony, it is also possible for the wall bores to extend obliquely so that there outermost end lies above or below the end of the exterior wall.

By introducing grouting anchors into the oblique bores it is possible for the floor and building wall to be, in a manner of speaking, stiched together.

To enable the formation of plugs of filler compound, in accordance with the present invention, the filler compound can be injected into inflatable sleeves surrounding the anchors along their entire length or at least a portion of their length, with such filling occurring after an insertion of the longitudinally extending and transversely extending anchors.

Alternatively, in accordance with further features of the present invention, it is possible to utilize, as a filler, an expansion compound introduced into a sleeve, with the compound in an unexpanded condition being introduced together with the anchor into the bores and expanding only after the addition of a catalyst.

Advantageously, in all cases, the anchors should be inserted into the bores together with a protective tube encompassing the anchors and the housing sleeve, with the protective tubes being pulled out again from the bores prior to the formation of the filler plugs.

By virtue of the features of the method of the present invention, it is possible to carry out a stabilization in a relatively economical fashion and in a quick manner without contaminating the interior rooms since essentially merely drilling operations are required at the site and, for this purpose, drilling templates can be employed.

The apparatus or auxiliary means employed for enabling the stabilization such as, for example, anchors may be prefabricated in a factory and merely inserted into the fores at the site and embedded into the filler compound. The interior rooms and the interior decoration are generally not effected by such upgrading or stabilization of the building or room.

For carrying out the method of the present invention, the apparatus or auxiliary means for enabling the subsequent stabilization of a room or building or building complex includes at least two long transversely extending anchors having a width of the floor being stabilized, with each anchor being encompassed by a flexible, extensible housing sleeve for accommodating a filler compound, and by a group of longitudinally extending anchors either equipped with rings for enabling a passing of the transversely extending anchors therethrough or being likewise encompassed by a housing sleeve for enabling a formation of filler plugs.

Advantageously, the housing sleeves are, in accordance with the present invention, encased in each instance by a protective tube which limits the expansion thereof, and the anchors can furthermore be provided with radial, disc-shaped, or axially oriented, blade-like spacers for the housing sleeve whereby an adequately unimpeded flow is ensured for the grouting compound and it is ensured that the thus-formed filler plug does not droop along one side of the anchor rod but rather embeds the anchor rod on all sides.

In order to ensure the existence of an extremely high pull-out resistance of the anchors, in accordance with the present invention, the anchors are embedded in a shape-mating fashion in the filler plug and the filler plug extends in a shape-mating fashion behind the longitudinal girders, building walls, and other mounting elements on the side of the building.

Grouting anchors with sleeves adapted to be filled by injection of a filler compound have been proposed in, for example, German Patent 2,315,859, European Patent 80-196 and European Patent 89-656. Tubular corrugated anchors are especially suitable and expensive since they can be manufactured relatively economically in large quantities and can be provided with outlet holes for the filler compound at respectively needed locations. However, the use of solid anchors is, basically, also likewise possible.

Provision can also be made in accordance with the present invention for the anchors to be equipped with additional control conduits terminating in a filler space, through which filler compound will flow back to the forward injection working site once the space has been adequately filled so that, at the site, the degree of filling of the housing sleeve at certain points can be monitored from the outside. Moreover, if, for example, the normally provided injection duct in the anchors should become clogged, the control orifices can also be utilized for enabling an injection of the filler compound.

BRIEF DESCRIPTION OF THE DRAWINGS

The above and other objects, features and advantages of the present invention will become more apparent from the following description when taken in connection with the accompanying drawings which show, for the purpose of illustration only, several embodiments in accordance with the present invention, and wherein.

DETAILED DESCRIPTION

Figure 1:
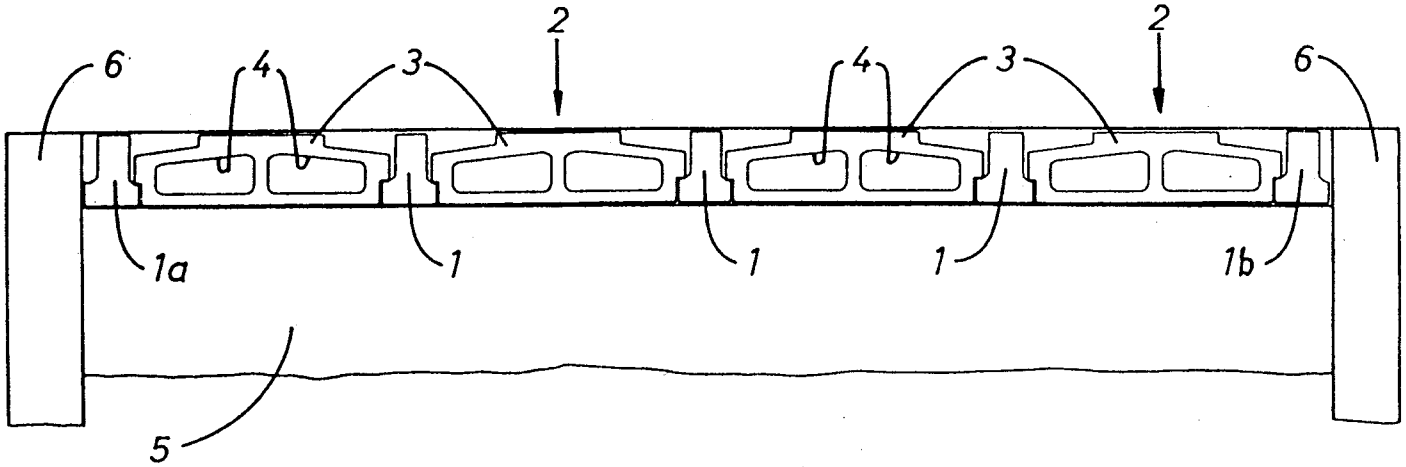
FIG. 1 is a schematic view of a first embodiment of a precast floor incorporating the principles of the present invention.

Referring now to the drawings wherein like reference numerals are used throughout the various views to designate like parts and, more particularly, to FIG. 1, according to this figure, a precast floor includes longitudinally extending girders 1 laid in parallel to one another having floor slabs generally designated by the reference numeral 2 interposed therebetween, with the floor slabs 2, for example, being constituted by laid-in-place floor blocks 3 each of which include axially extending cavities 4. Respective opposite ends of the longitudinally extending girders 1 rest on building end walls 5, with the floor assembly being encompassed, in the schematic view of FIG. 1, between building side walls 6 disposed in parallel to the longitudinally extending girders 1.

Figure 2:
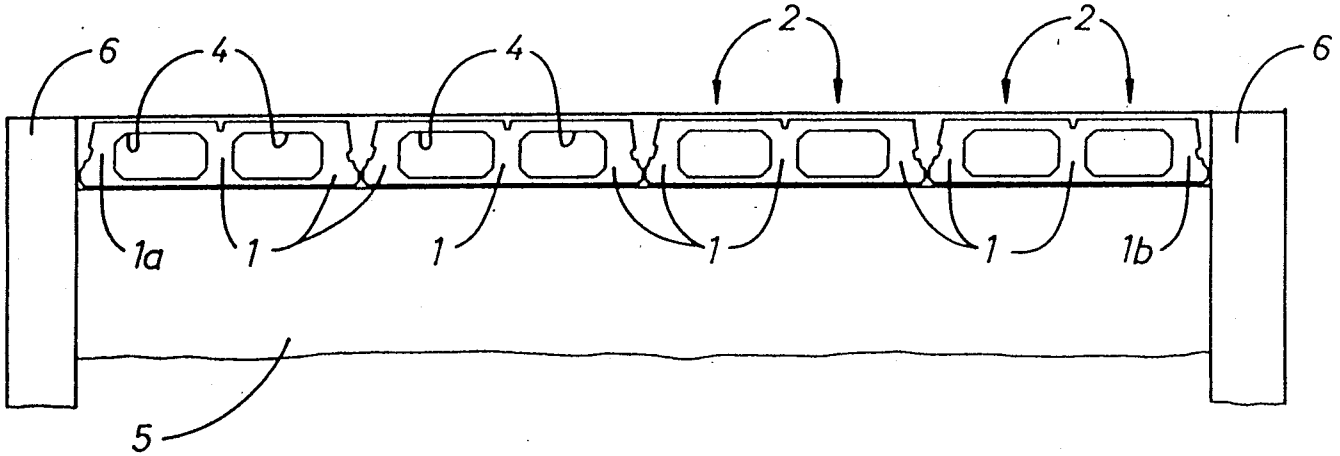
FIG. 2 is a schematic view of a second embodiment of a precast floor incorporating the principles of the present invention.

In the precast floor of FIG. 2, continuously extending prefabricated parts are provided with each including longitudinally extending cavities 4, wherein web walls laterally defining the cavities 4 correspond to the longitudinal girders of FIG. 1.

Figure 3:
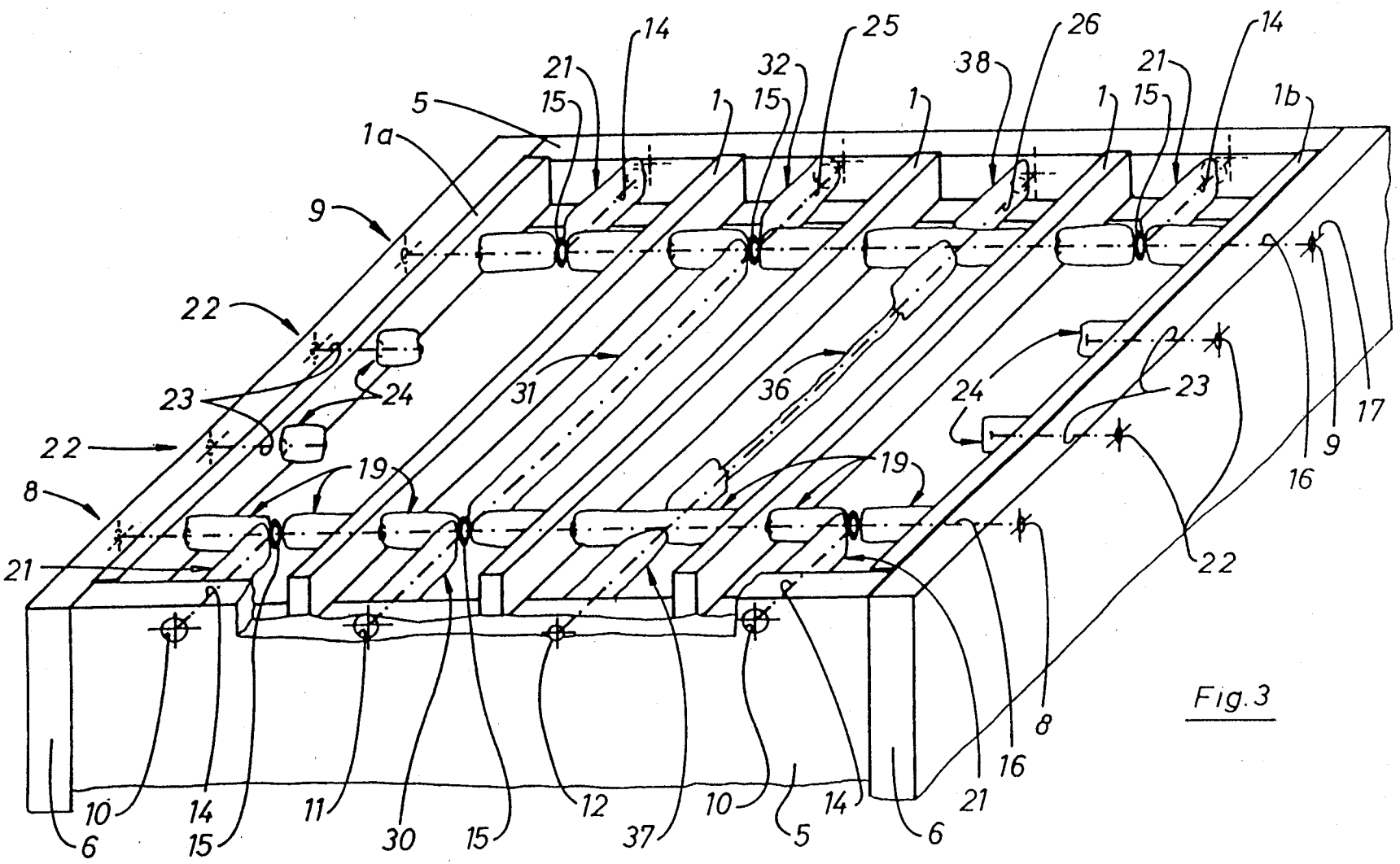
FIG. 3 is a schematic perspective view of a portion or zone of a floor illustrating a formation of a ring anchor and floor stabilization according to the present invention.

In FIG. 3, only the longitudinally extending girders 1 of the floor illustrated while the floor sections forming the intermediate floor slabs and provided with the cavities are not shown for the purposes of clarity. The longitudinally extending girders 1 rest with their respective ends on the end walls 5 provided with a corner recess, and the two externally located longitudinally extending girders 1*a*, 1*b* extend directly beside the respective side walls 6. As readily apparent from FIG. 3, the building walls 5, 6 can be urged apart during an earthquake or in a gas explosion so that the longitudinally extending girders 1 will cave in. In the case of, for example, a gas explosion, the danger arises that the longitudinally extending girders 1 may be propelled upwardly and then do not settle on the building end walls 5 but rather cave in past the end walls 5. In order to counteract this danger or hazard, according to the present invention the floor zone is stabilized in the manner shown in FIG. 3 by the formation of a ring anchor.

For this purpose, aligned transversely extending bores 8, 9 are drilled or otherwise formed into the respective building side walls 6 and the longitudinally extending girders 1 in proximity to the longitudinal ends of the longitudinally extending girders 1. Moreover, longitudinally extending bores 10, 11, 12 are formed in the respective building end walls 5 in a region of the continuously extending cavities 4.

Figure 7:
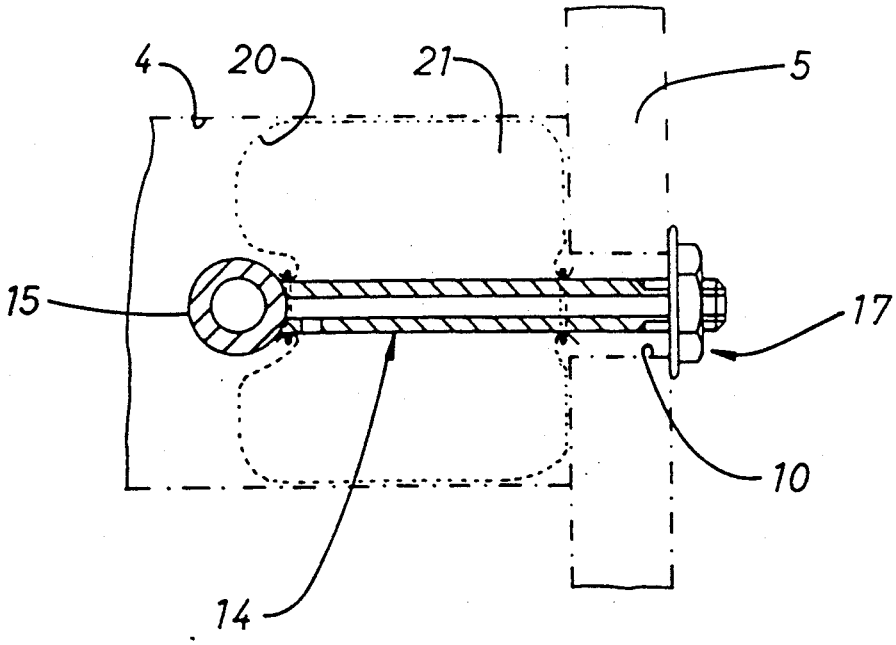
FIG. 7 is a partial cross-sectional schematic view of a short anchor constructed in accordance with the present invention with a ring eye for receiving an intersecting anchor.

As shown most clearly in FIG. 7, grouting anchors 14 are inserted into the longitudinally extending bores 10, with the grouting anchors 14 carrying, on an end thereof to be inserted into the respective bores 10, a ring 15 oriented or disposed so that a longitudinal central axis thereof extends transversely to a longitudinal center axis of the anchors 14. Thereafter, a long anchor 16 is introduced through the row of aligned transverse bores 8, 9 and rings 15 of the grouting anchors 14, with a length of the long anchor 16 corresponding to a total width of the floor region to be upgraded or stabilized.

The anchors 14, 16 are anchored at their exteriorly disposed ends in each case to the building walls 5, 6 by, for example, end pieces 17. Subsequently filler compound is injected into a sleeve 18 surrounding the grouting anchor 16, whereby plugs 19 of filler compound are formed in each case between the longitudinally extending girders 1 and the rings 15, thereby fixing the longitudinally extending girders 1 in their mutual position in the transverse direction and with respect to the respective building side walls 6. Then filler compound is also pressed into the sleeves 20 of the grouting anchors 14 s that the sleeves 20 are expanded within the cavities 4 and form filler plugs 21 which fix the grouting anchors 14 in position within the cavities 4 and also additionally support the transversal extending anchors 16 at the respective end walls 5.

If in a building wall of FIG. 3 the longitudinal girders 1 are subsequently respectively reinforced by one transversely extending anchor 16 and a plurality of longitudinally extending anchors 14, then the edge zone of the floor with the adjoining building walls is already joined to the adjacent walls by a ring anchor, which ring anchor is completed, in a zone of the building side walls, precisely by the respective outer walls 6 and by two externally or outwardly disposed longitudinally extending girders 1*a*, 1*b*.

However, it is also possible, at least in the case of relatively large floor surface areas, for the respective outer walls 6 and neighboring longitudinally extending girders 1*a*, 1*b* to be provided with additional transverse bores 22 into which grouting anchors 23 are introduced carrying a filler sleeve into which thereafter grouting compound is injected so that filler plugs 24 result. The filler plugs 24 are, in each case, in contact with insides of the respective longitudinally extending girders 1*a*, 1*b* lying at an inward side of the floor and, together with other anchoring elements 17, clamp the longitudinally extending girders 1*a*, 1*b* together with the respective side walls 6.

Figure 8:
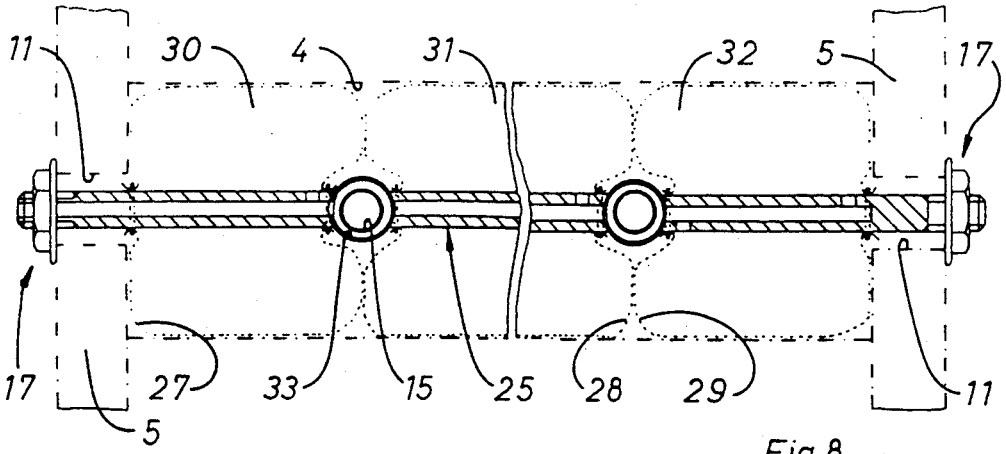
FIG. 8 is a partial cross-sectional schematic view of an anchor constructed in accordance with the present invention with several rings distributed over a length thereof for receiving intersecting anchors.

If the floor is also to be stabilized over its surface area, long continuously extending grouting anchors 25 or 26 may be inserted in several or all of the longitudinally extending bores 10, 11, 12 on the wall side. The grouting anchor 25, as shown in FIG. 8, includes two rings 15, with each ring 15 serving to accommodate the two transverse anchors 16. The longitudinal anchor 25, constructed as a tubular grouting anchor, is surrounded by several sleeves 27, 28, 29 so that large filler plugs 30, 31, 32 can be formed. The central filler plug 31 may, for example, occupy the entire cavity 4 between the two transverse anchors 16. In a region of the two rings, the adjoining tubular sections of the grouting anchor 25 are in communication with each other by way of a bypass conduit 33.

Figure 9:
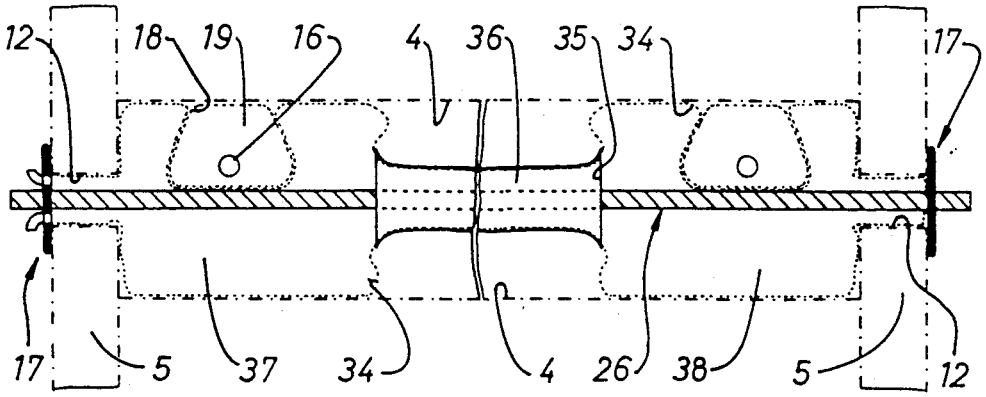
FIG. 9 is a partial cross-sectional schematic view of a solid grouting anchor constructed in accordance with the present invention for enabling a formation of two filler plugs in intersecting regions of the anchor.

As shown in FIG. 9, the anchor 26 is a solid longitudinally extending anchor incorporated at a level displacement with respect to the transverse anchors 16, with the anchor 26 being, for example, of the same construction as the transverse anchors 16. In this construction, the cavity 4 between the transverse anchors 16 is not entirely filled with a plug of filler compound for, for example, weight reasons. Consequently, a protective hose 35, which expands only slightly, is placed about the filler sleeve 34, with the hose 35 preventing the formation of a filler plug in a central zone of the longitudinally extending girder and permitting only the formation of a relatively thin connecting strand 36 of injection compound between the plugs 37, 38. The plugs 37, 38 are each intersected approximately in a center thereof by a transverse anchor 16.

During the formation of the filler plugs 19 along the transverse anchors 16, the hose 35 or the filler plug 19 is prevented from expansion on one side thereof by the longitudinal anchor 26. During a subsequent formation of the plugs 37, 38 along the anchor 26,.the plugs 37, 38 fill out the space that remains vacant in a zone of the points of intersection and brings out a shape-mating anchorage of the intersecting plugs 19, 37 and 19, 38 respectively.

Figure 4:
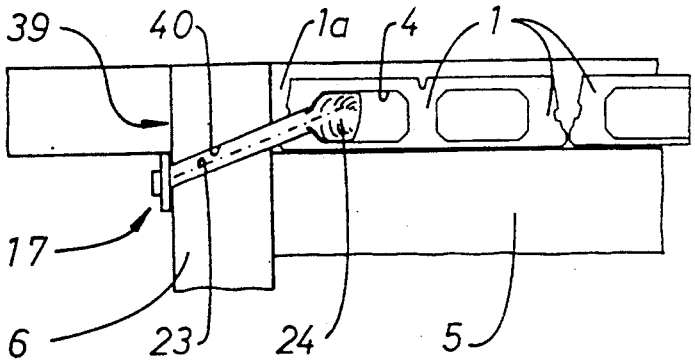
FIG. 4 is a schematic view of a wall-floor anchorage of the present invention with an obliquely oriented anchor.

FIG. 4 provides an example of a clamping connection of the exteriorly located longitudinally extending girders 1*a* with a side wall 6 in a situation where there is a floor continuation or a balcony adjoining the floor level at an exterior side so that the wall 6 in an upper region 39 is not accessible for applying a drill or otherwise forming a hole. In this arrangement, the bore 40 is oriented obliquely in the manner illustrated in FIG. 4 and the anchor 23 is mounted obliquely in the manner shown in FIG. 4.

Figure 5:
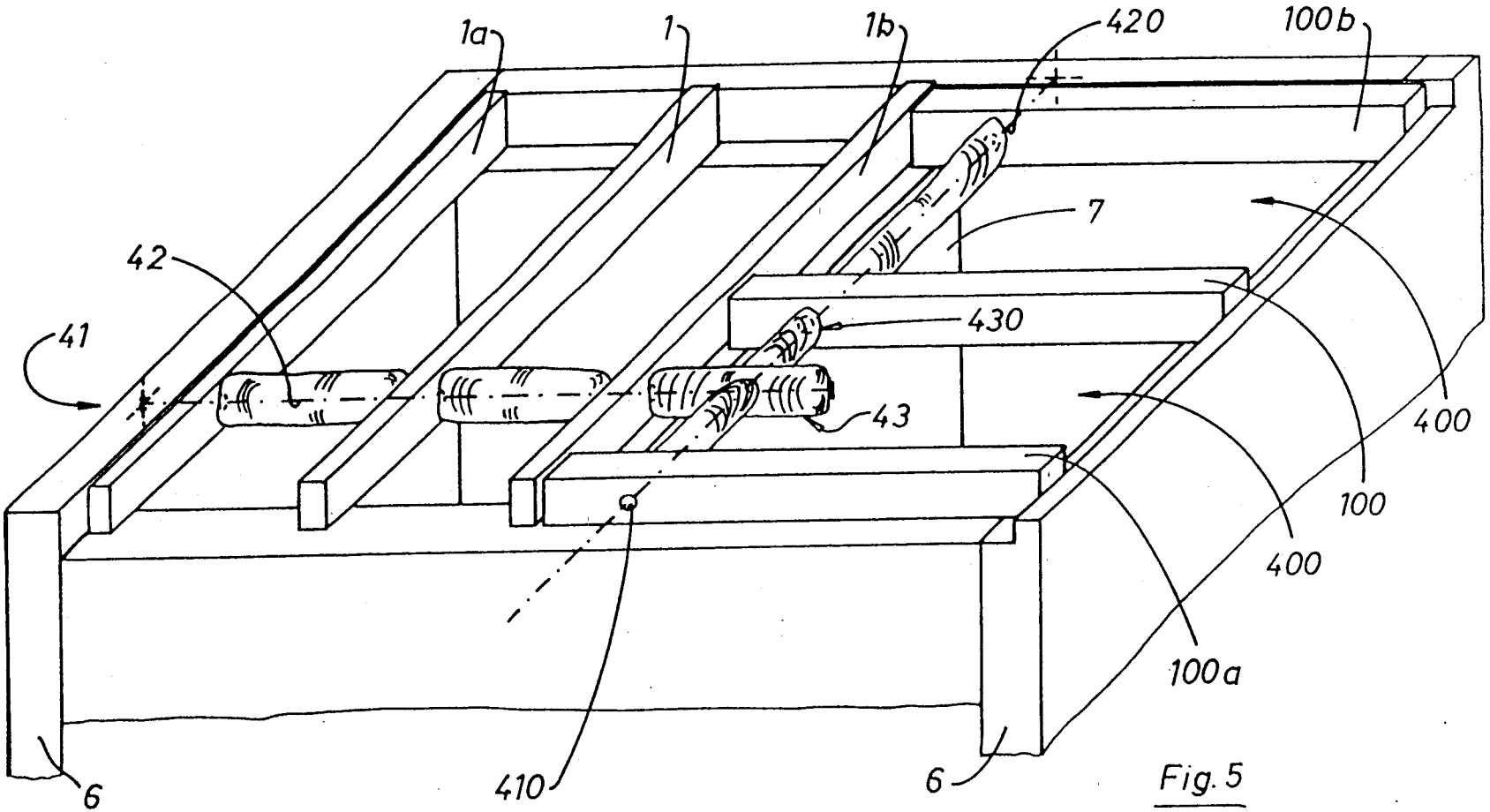
FIG. 5 is a schematic perspective view of a floor zone stabilized in accordance with the present invention, with two floor slabs wherein the longitudinal girders thereof are respectively oriented perpendicularly to one another.

FIG. 5 provides and example of a special situation wherein two floor slabs are present within a floor zone to be stabilized wherein the longitudinally extending girders are oriented in one slab at an angle of 90° offset with respect to the other floor slab. In FIG. 5, the longitudinally extending girders 1*a*, 1*b*, of one slab are provided with transverse bores 41 into which grouting anchors 42 are respectively introduced, with the grouting anchors 42 projecting up into the cavities 400 lying between the transversely oriented or disposed longitudinally extending girders 100*a*, 100 and 100*b*. The longitudinally extending girders 100*a*, 100, 100*b* are respectively provided with a transverse bore 410 for accommodating a grouting anchor 420, with the transverse bore 410 being arranged in relatively close proximity to a neighboring longitudinal girder 1*b* and offset vertically with respect to the bore 41. During the successively performed injection process, the filler plugs 43, 430 are anchored, in each case, in a shape-mating fashion in the intersection zone similar to the plugs 19/37 and 19/38, respectively. Both floor areas are thus anchored together in the region of an intermediate wall or partition 7. Additionally, the intermediate wall or partition 7 can be clamped together with the longitudinal girders 1*b* in the manner shown in FIG. 1 by short obliquely extending or oriented anchors.

Figure 6:
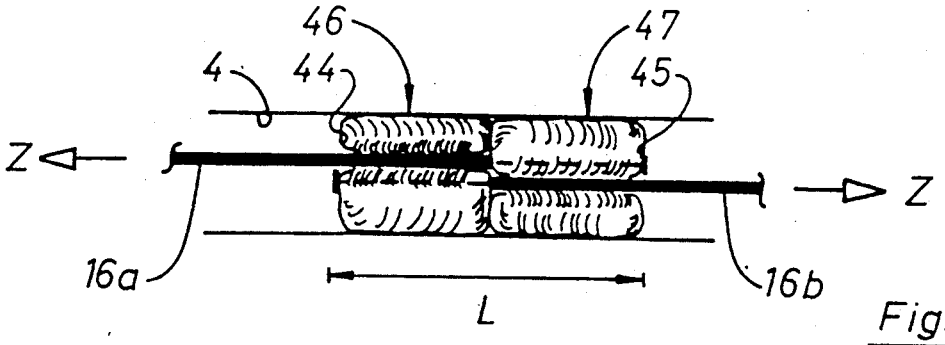
FIG. 6 is a schematic view illustrating an axial tensile clamping of two overlapping grouting anchors in accordance with the present invention.

In FIG. 6, a longitudinally extending anchor or a transversely extending anchor includes two sectional anchors 16*a*, 16*b* each of which is inserted from opposite sides in the bore. The anchors are introduced with an overlapping length L and each carry at their ends a filler sleeve 44, 45 having approximately a length of one half of the overlapping length L. During the subsequent injection of the grouting compound, the plugs 46, 47 illustrated in FIG. 6 and, preferably, filling the cross section of the cavities 4 entirely, are formed at the ends of each of the anchors 16*a*, 16*b*. The plugs 46, 47 extend one behind the other in an anchor pulling direction Z, thereby constituting a shape-mating tension anchorage.

Figure 10:
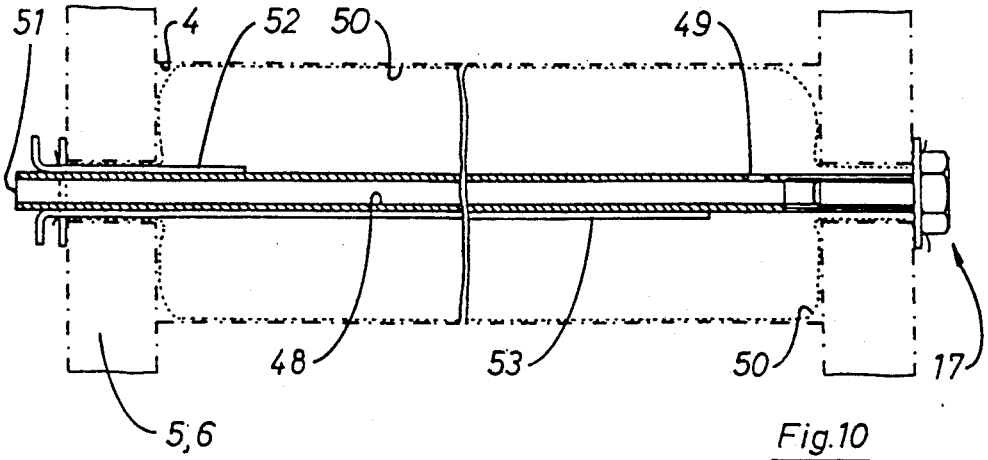
FIG. 10 is a partial cross-sectional schematic view of a hollow anchor constructed in accordance with the present invention including a housing sleeve and two back flow tubules terminating at different locations of an interior of the sleeve for controlling a filling degree of the grouting compound.

FIG. 10 provides an example of a grouting anchor usable as a transversely extending anchor 16 or a longitudinally anchor 26, with a central injection channel 48 terminating by a radial bore 49 provided at an interiorly located end into a surrounding sleeve 50. On an outside of the anchor tube, two control tubules 52, 53 are arranged which terminate at varying longitudinal points in the innerspace of the sleeve 50 and are extended up to the forward end of the anchor tube 51. During an injection, a backflow of grouting compound through the control tubules 52, 53 comes about in case of a corresponding filler compound pressure so that a degree of filling of the sleeve 50 can be observed from an injection side and can be evaluated.

The anchors of the present invention, especially in the case where longitudinally or transversely extending anchors with injection sleeves are involved which extend over a full floor zone, are suitably packaged by the manufacturer within a protective tube and shipped in this form. The anchors are inserted into the bores together with the protective tubes so that the sleeves will not be damaged by contact with possibly sharp-edged stone corners or the like. The anchors are then retained at the opposite end wall with their pushed-through end and the protective tube is retracted.

I claim:

1. A method for a subsequent stabilization of a building having spaced side walls and spaced end walls extending transversely to the side wall, a precast floor including a plurality of longitudinally extending girders having opposite ends resting on the respective end walls of the building, and intermediate floor slabs each including continuously longitudinally extending cavities, said intermediate floor slabs being located between adjacent longitudinally extending girders, the method comprising the steps of:

clamping the respective longitudinally extending girders to each other by transversely extending grouting anchors, clamping two outermost longitudinally extending girders defining outer limits of the floor to the respective building side walls adjoining the outermost longitudinally extending girders by transversely extending grouting anchors, clamping the respective longitudinal extending girders to the end walls of the building by longitudinally extending grouting anchors and ring members connected to the transversely extending grouting anchors clamping the respective longitudinally extending girders to each other, and subsequently forming filler plugs embedding the grouting anchors so that the filler plugs of the transversely extending grouting anchors contacts the respective longitudinally extending girders, with the precast floor being stabilized by the ring members and said filler plugs.

2. A method for a subsequent stabilization of a building having spaced side walls, spaced end walls, and a precast floor including a plurality of longitudinally extending girders having opposite ends thereof resting on end walls of the building and intermediate floor slabs each including longitudinally extending continuous cavities, the intermediate floor slabs being respectively located between adjacent longitudinally extending girders, the method comprising the steps of:

providing a plurality of transversely and longitudinally extending anchors, arranging the transversely and longitudinally extending anchors in a lattice fashion in a zone of the floor to be stabilized, embedding the longitudinally and transversely extending anchors in filler plugs, and clamping the zone of the floor to be stabilized to the side walls and the end walls of the building.

3. A method according to claim 1, wherein the steps of clamping the respective longitudinally extending girders to each other and clamping the two outermost longitudinally extending girders to the side walls of the building includes providing each of the side walls and the longitudinal girders with a transversely extending bore in proximity to the respective ends of the respective longitudinal girders, said transversely extending bores of the respective girders and the side walls of the building being disposed in alignment, providing further bores in each of the end walls of the building on which the longitudinal girders rest with axial extensions of the further bores intersecting axial extensions of the transversely extending bores within the respective cavities, respectively inserting the longitudinally extending anchors into the further bores, respectively inserting the transversely extending anchors into the transversely extending bores in the longitudinal girders and the side walls of the building, coupling the transversely extending anchors to the longitudinally extending anchors at respective points of intersection of the transversely extending anchors and the longitudinally extending anchors, and wherein the step of forming filler plugs includes injecting a grouting compound in the respective transverse anchors whereby filler plugs are formed within the respective cavities, with the plugs being in contact with the respective longitudinally extending girders and the longitudinally extending anchors so as to fix the same in position in a transverse direction, and injecting grouting compound into the respective longitudinally extending anchors, whereby the filler plugs are formed in the respective cavities so as to interlock with the filler plugs of the transverse anchors in a shape-mating fashion at the points of intersection and immovably clamp the transversely extending anchors and the longitudinally extending girders connected thereto in place with respect to the end walls of the building.

4. A method according to claim 1, wherein the side walls of the building and each of the longitudinally extending girders are provided with aligned transversely extending bores at least in proximity to respective ends of the longitudinally extending girders, and wherein the step of clamping the respective longitudinally extending girders to each other and the two outermost longitudinally extending girders to the side walls includes inserting transversely extending anchors into the aligned transverse bores, and wherein the step of forming filler plugs includes injecting a compound into the respective transversely extending anchor so that filler plugs are formed in cavities respectively disposed in the floor inwardly of the respective outer longitudinal girders whereby the filler plugs embed the transversely extending anchors and extend, in each case, behind the outermost longitudinally extending girders in a region of the transversely extending bores.

5. A method according to claim 1, wherein an intermediate wall is disposed between and extends in parallel to said side walls, further comprising the step of clamping the intermediate wall to one of the longitudinally extending girders by providing at least one obliquely extending bore having a first end opening above or below the floor and a second end opening into one of the cavities, inserting a grouting anchor into said obliquely extending bore, and forming a filler plug in said one of said cavities.

6. A method according to claim 1, wherein each of the transversely extending anchors includes an inflatable sleeve encompassing the respective transversely extending anchors, and wherein the step of forming filler plugs includes injecting filler compounds into the inflatable sleeves after positioning the longitudinally and transversely extending anchors.

7. A method according to claim 1, wherein the step of forming the filler plugs includes introducing an expansion material into a sleeve surrounding the respective transversely extending grouting anchors, placing the transverse anchors with the expansion material in an unexpanded condition, and forming the filler plugs only upon an addition of a catalyst to the expansion material.

8. A method according to claim 7, wherein the step of forming the filler plugs includes introducing an expansion material in an unexpanded condition into a sleeve surrounding each of the longitudinally extending grouting anchor simultaneously with a placing of the transversely extending grouting anchors and adding a catalyst to the expansion material whereby the respective longitudinally extending grouting anchors are brought into engagement with inner sides of the building end walls and the respective transversely extending anchors.

9. A method according to claim 7, wherein the step of forming the filler plugs includes introducing a filler compound into a sleeve surrounding the respective longitudinally extending grouting anchors subsequent to a placement of the transversely extending anchors whereby the respective longitudinally extending grouting anchors are brought into engagement with inner sides of the building end walls and the respective transversely extending anchors.

10. A method according to claim 1, wherein each of the longitudinally extending girders and each of the side walls include aligned transversely extending bores provided in proximity to respective opposite ends of the longitudinally extending girders, further bores are provided in each of the end walls for respectively accommodating the longitudinally extending grouting anchors, and each of the longitudinally extending grouting anchors and transversely extending grouting anchors are provided with a protective tube surrounding the respective grouting anchors, wherein said transversely extending grouting anchors and associated protective tubes are inserted into the respective aligned transversely extending bores and sad longitudinally extending grouting anchors and associated protective tubes are inserted into the respective further bores, and wherein the protective tubes are removed from the respective bores prior to the step of forming the filler plugs.

* * * * *